US010337821B1

(12) United States Patent
Garner et al.

(10) Patent No.: US 10,337,821 B1
(45) Date of Patent: Jul. 2, 2019

(54) STABLE MOUNT FOR ACTUATABLE DEVICES

(75) Inventors: Russell S Garner, Huntland, TN (US); Dan F Lighton, Huntsville, AL (US); John T Dillon, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 3341 days.

(21) Appl. No.: 12/313,788

(22) Filed: Nov. 21, 2008

(51) Int. Cl.
*F41A 23/12* (2006.01)
*F41A 27/06* (2006.01)

(52) U.S. Cl.
CPC ..... *F41A 23/12* (2013.01); *F41A 27/06* (2013.01)

(58) Field of Classification Search
CPC ..... F41A 23/00; F41A 23/02; F41A 23/12; F41A 23/52; F41A 27/00; F41A 27/06
USPC ..... 248/188.8, 431, 188.7, 676; 89/37.01, 89/37.13, 40.03, 40.06
See application file for complete search history.

(56) References Cited

U.S. PATENT DOCUMENTS

| | | | | |
|---|---|---|---|---|
| 1,810,654 | A * | 6/1931 | Haubroe | 89/40.06 |
| 2,415,340 | A * | 2/1947 | D Ardenne et al. | 89/37.03 |
| 4,667,565 | A * | 5/1987 | Anderson | 89/36.08 |
| 5,354,024 | A * | 10/1994 | Vinghog | F41A 23/14 248/166 |
| 6,286,411 | B1 * | 9/2001 | Sanderson | 89/37.16 |
| 7,086,192 | B2 * | 8/2006 | Deros | F41A 23/02 248/278.1 |
| 7,143,986 | B1 * | 12/2006 | Austin | F41A 23/08 248/187.1 |
| 7,610,842 | B1 * | 11/2009 | Brooks | 89/37.03 |
| 2004/0237372 | A1 * | 12/2004 | Frye | 42/94 |
| 2008/0202326 | A1 * | 8/2008 | Carroll et al. | 89/38 |
| 2010/0218668 | A1 * | 9/2010 | McClellan | 89/36.04 |

* cited by examiner

*Primary Examiner* — Lisa L Tsang
(74) *Attorney, Agent, or Firm* — Michael K. Gray; Hay Kyung Chang

(57) ABSTRACT

A stable mount is secured firmly to the bed of a vehicle and is of sufficient height to reach an opening in the roof level. The stable mount has five primary parts made of a suitable material and constructed together with welds. The mount has sufficient rigidity such that the first resonant mode of vibration of the mount is greater than the post-actuation resonance of the mounted weapon so that optimal gun bolt actuation is realized and the jamming of rounds is prevented.

6 Claims, 3 Drawing Sheets

STABLE MOUNT FOR ACTUATABLE DEVICES

DEDICATORY CLAUSE

The invention described herein may be manufactured, used and licensed by or for the Government for governmental purposes without the payment to us of any royalties thereon.

BACKGROUND OF THE INVENTION

Many devices, such as missiles and guns, vibrate upon being actuated (fired). This post-actuation vibration phenomenon is associated with the inertia of the bolt action of the weapon and can affect the performance of the gunfire rate. The bolt occurs due to the force generated by firing the round which pushes the bolt rearward to engage the next round and load it into the chamber. The operation of a given weapon occurs at a specified firing rate. If the vibration of the mount on which the weapon is mounted is out of phase with the operation of the bolt, then the inertia associated with the bolt motion can be reduced which, in turn, can reduce the rate of fire and performance efficiency of the weapon. A stable mount with a desired natural frequency would enable optimal performance of the weapon.

In cases of weapons which are too heavy to be mounted directly onto the roof of some combat vehicles, a mount is needed to support the weapons from inside the vehicles and still allow the weapons to be exposed at the roof level.

SUMMARY OF THE INVENTION

A stable mount according to the present invention stands inside a vehicle. The mount is secured firmly to the bed of the vehicle and is of sufficient height to reach the roof level. An opening in the roof allows a weapon to be mounted on the stable mount so the weapon is above and outside of the vehicle.

The stable mount has five primary parts which include a center tube, a plurality of supporting legs, a mounting plate, multiple gussets and interface plates, with one interface plate on the bottom of each leg for securing each leg onto the bed of the vehicle. These parts are made of a suitable material, such as square steel tubing and steel plates of pre-selected thicknesses, and are constructed together with welds to yield a mount that has a sufficient rigidity such that the first resonant mode of vibration of the mount is greater than the post-actuation resonance of the mounted weapon. In having a first resonant mode of vibration which is greater than the post actuation resonance of the mounted weapon, the invention prevents jamming of the rounds and optimal gun bolt actuation is realized.

DESCRIPTION OF THE PREFERRED EMBODIMENT

Figure 1:
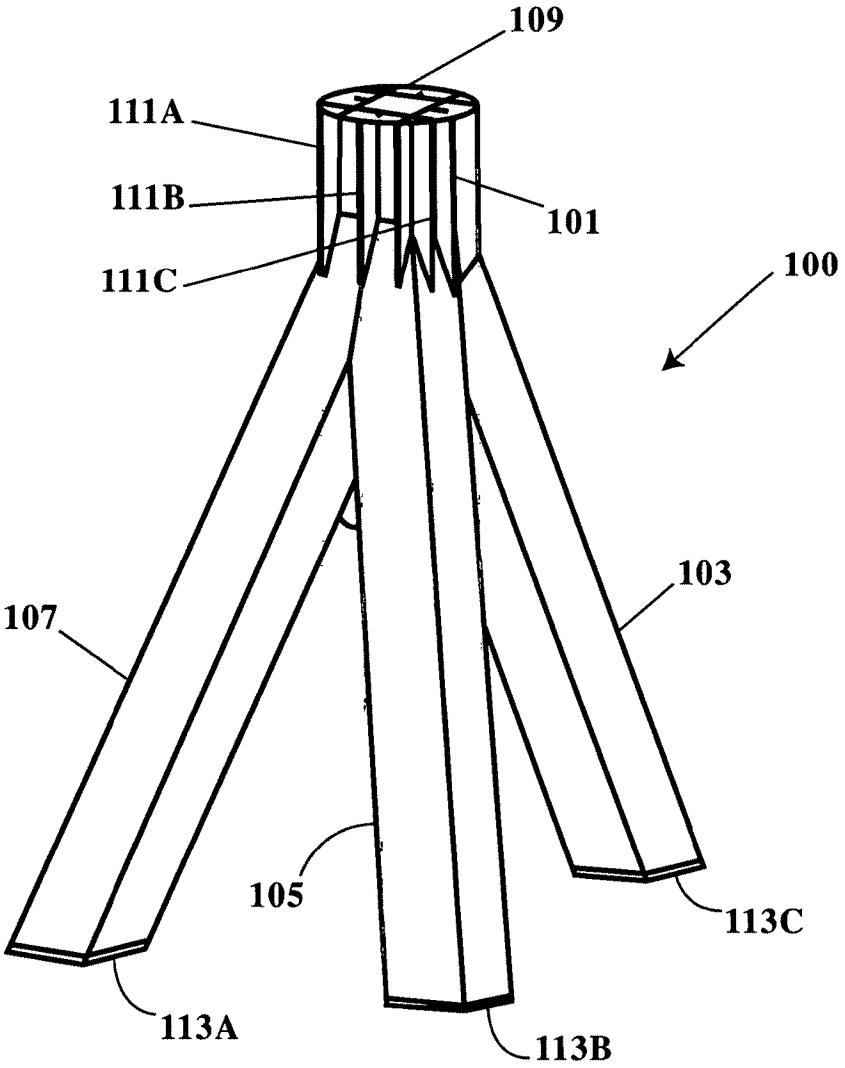
FIG. 1 is an isometric view of the stable mount and shows a preferred embodiment of the mount.

Referring now to the drawing wherein like numbers represent like parts in each of the several figures, the structure and material of the stable mount is explained in detail. For convenience, the explanation is given with reference to a stable mount intended for the remote weapon system with Javelin missile (RWSJ). However, such a stable mount may be fabricated for any actuatable device, taking into consideration factors such as the operational resonance of the device and the properties of the material chosen for the mount to provide the necessary rigidity to support the device while allowing it to operate properly.

As shown in FIG. 1, stable mount 100 is comprised of five primary parts: center tube 101, a plurality of supporting legs 103, 105 and 107, mounting plate 109, multiple gussets 111A, 111B, 111C, etc. and interface plates 113A, 113B, 113C, with one interface on the bottom of each leg for securing each leg onto the bed of the vehicle. These parts are made of a suitable material, such as square steel tubing and steel plates of pre-selected thicknesses, and are constructed together with welds to yield a mount that has a sufficient rigidity such that the first resonant mode of vibration of the mount is greater than the post-actuation resonance of the mounted weapon. In having a first resonant mode of vibration which is greater than the post actuation resonance of the mounted weapon, the invention prevents jamming of the rounds and optimal gun bolt actuation is realized.

Therefore, any and all of the numerical dimensions and values that follow should be taken as nominal values rather than absolutes or as a limitation on the scope of the invention. These nominal values are examples only; many variations in size, shape and types of materials may be used for the mount, depending mainly on the particular weapon to be supported by the mount but also on the vehicle in which the mount is to be installed, as will readily be appreciated by one skilled in the art, as successfully as the values, dimensions and types of materials specifically set forth hereinafter. In this regard where ranges are provided, these should be understood only as guides to the practice of this invention.

The RWSJ suite consists of a Browning M2 12.7 mm machine gun, a 40 mm automatic grenade launcher, a M240 7.62 mm machine gun and a Javelin missile. The suite is also fitted with zoomable CCD camera, uncooled IR sensor and a laser range finder and operates with a bolt frequency of 30 Hz.

The operation of the weapons in the suite and the optical devices require a stable platform to achieve optimum performance. This is provided by a mount that maintains a rigidity that gives the mount a first resonant mode of vibration greater than 30 Hz so as to ensure proper operation of the weapon. If the first resonant mode of vibration of the mount is less than 30 Hz, the M2 machine gun performance will be degraded and could result in rounds being jammed during the actuation of the bolt.

Figure 2:
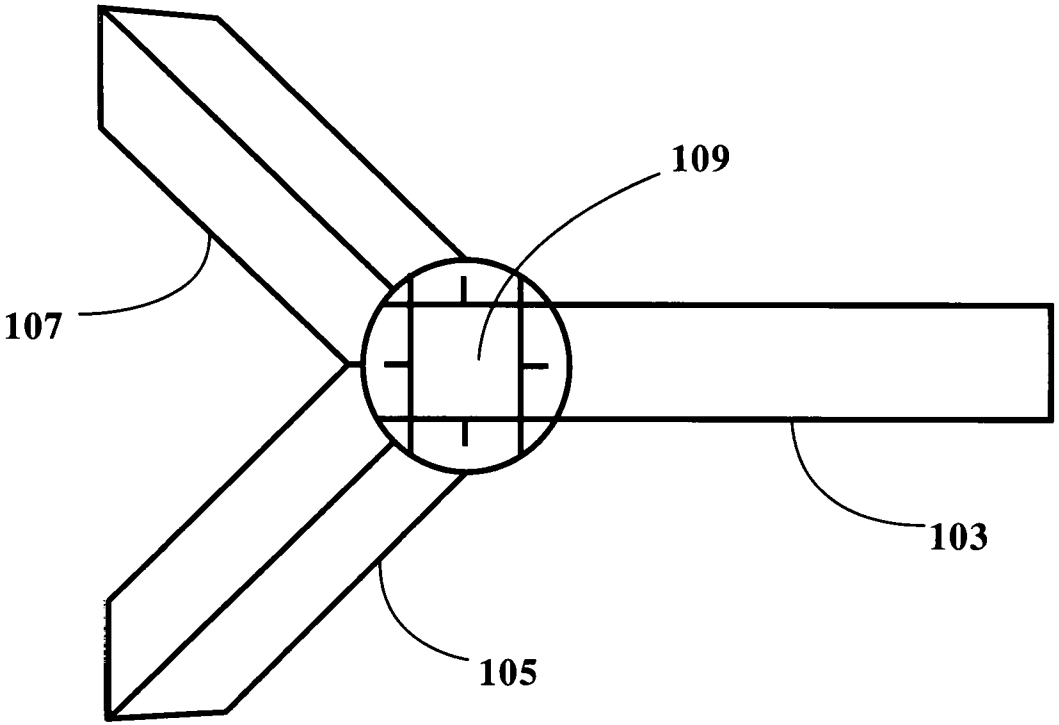
FIG. 2 presents a top view of the mount, detailing the mounting plate.

Stable mount 100 is comprised of center tube 101, at least three legs 103, 105 and 107 extending from the center tube and a mounting plate 109 coupled to the top surface of the center tube. (FIGS. 1 and 2). The stable mount is securable to a floor or platform. For example, the stable mount can be situated on the floor or bed of the vehicle (not shown) so as to extend from the floor to the roof level. A cut-out or opening in the vehicle's roof would allow for an actuatable device, e.g., a machine gun, to be mounted securely on the mounting plate above the roof level of the vehicle.

Some suitable materials for the center tube and legs are steel tubing and for the mounting plate a steel plate. In the case of a mount for the RWSJ suite to be used inside a high-mobility multi-wheeled vehicle (HMMWV®), the steel tubing for the center tube may be a cylindrical tube and the legs may be a 4-inch square tube with a 0.375-inch wall thickness and the plate may be made of 0.5-inch-thick, circular steel plate. Using the square tubing for the legs provides greater rigidity and structural integrity, and consequently greater support for the actuatable device, than using a round tube.

Structural integrity is further helped by using a plurality of gussets 111 which are positioned along the length of the center tube and fixedly coupled between the mounting plate and the legs. Additionally, each leg is secured onto the bed of the vehicle by an interface plate that is bolted firmly onto the bed, using, for example, ½-13 bolts and pre-existing hard points in the bed of the HMMWV®. The gussets and the interface plate may be fashioned from 0.5-inch-thick steel plates.

The parts of the entire stable mount are welded together via ⅜-inch fillet welds.

A stable mount constructed as described above has a first resonant mode of vibration that is greater than 30 Hz which ensures proper operation of the RWSJ weapon that is mounted on the stable mount. This allows the soldier to remain inside the vehicle and not be directly exposed in the battlefield. It enables the gunner to be in the best possible position to engage the enemy for a first hit probability at any distance and speed of the target. This makes it possible for the RWSJ weapon to be integrated into combat vehicles whose roof structure contains an azimuth ring bearing and thus cannot carry the load induced by the RWSJ weapon, particularly under crash load requirements.

Figure 3:
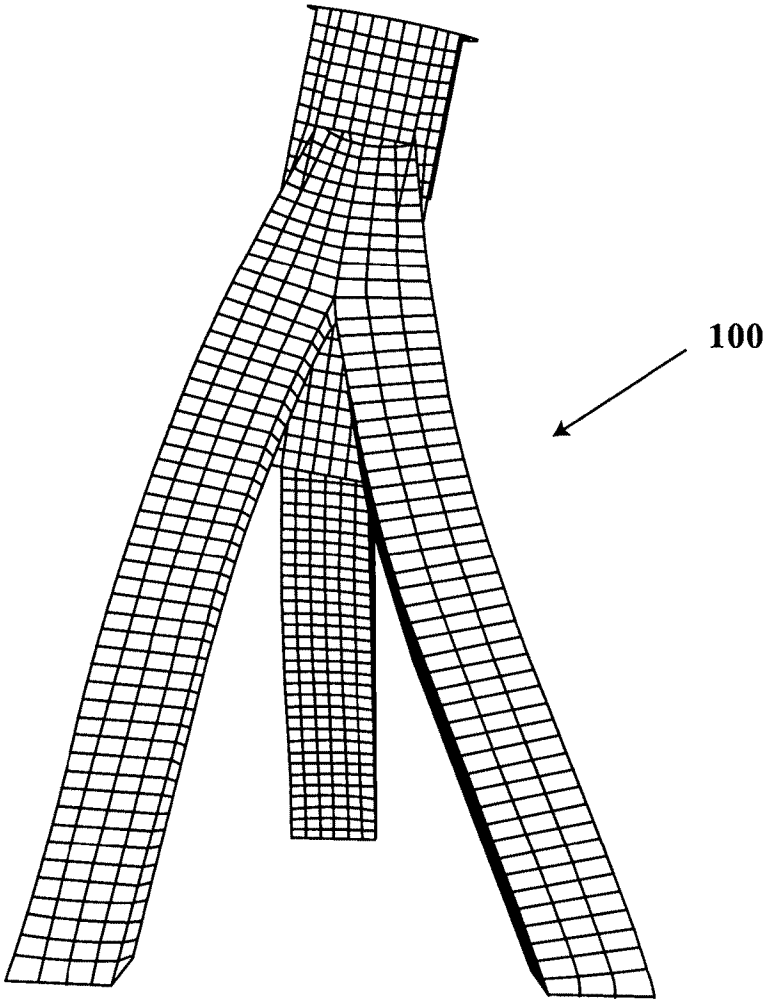
FIG. 3 illustrates the first resonant mode of 35 Hz for stable mount constructed to support and enable proper operation of the remote weapon system with Javelin missile.

As demonstrated in FIG. 3, a first resonant mode of 35 Hz for a stable mount according to the present invention enables proper operation of a remote weapon system with Javelin missile.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed is:

1. A stable mount comprising:

a center tube having a top surface;

at least three legs extending from said center tube;

a mounting plate attached to said top surface;

and a plurality of gussets fixedly coupled between said mounting plate and said at least three legs; and wherein:

said center tube, said at least three legs, said mounting plate and said plurality of gussets are made of steel and welded together such that a first resonance mode of vibration of said stable mount is greater than 30 Hz.

2. A stable mount according to claim 1 wherein said at least three legs are comprised of square steel tubes.

3. A stable mount according to claim 2, wherein said center tube is cylindrical in shape.

4. A stable mount according to claim 3, wherein said mounting plate and said gussets are fashioned from steel plates.

5. A stable mount according to claim 1, wherein said mount has a first resonance mode of vibration of 35 Hz.

6. A stable mount according to claim 5, further comprising:

a plurality of interface plates with each leg of said at least three legs having a corresponding interface plate of said plurality of interface plates attached thereto.

* * * * *